United States Patent [19]

Irwin

[11] Patent Number: 4,901,388

[45] Date of Patent: Feb. 20, 1990

[54] WATER BED CORNER CLOTHES HOLDER

[76] Inventor: Dick D. Irwin, 4698 18th St., Byron, Mich. 49315

[21] Appl. No.: 266,828

[22] Filed: Nov. 3, 1988

[51] Int. Cl.[4] ..... A47C 21/02

[52] U.S. Cl. ..... 5/498; 24/72.5

[58] Field of Search ..... 5/494, 496, 498; 24/72.5, 230.5 AD, 230.5 W, 546, 67.9

[56] References Cited

U.S. PATENT DOCUMENTS

| | | | |
|---|---|---|---|
| 718,768 | 1/1903 | Juslin | 24/230.5 W |
| 2,019,947 | 11/1935 | Allen | 24/72.5 |
| 2,653,363 | 9/1953 | Lievsay, Jr. . | |
| 4,174,552 | 11/1979 | Franklin | 24/230.5 W |
| 4,276,667 | 7/1981 | Osborne . | |
| 4,541,137 | 9/1985 | Murray . | |
| 4,712,262 | 12/1987 | Viggiano | 24/72.5 |
| 4,782,543 | 11/1988 | Hutton et al. | 24/72.5 |
| 4,809,377 | 3/1989 | Lynn | 24/72.5 X |

FOREIGN PATENT DOCUMENTS

| | | | |
|---|---|---|---|
| 191634 | 1/1923 | United Kingdom | 24/72.5 |

*Primary Examiner*—Michael F. Trettel

*Attorney, Agent, or Firm*—Wilfred O. Schmidt

[57] ABSTRACT

A resilient corner bed clothes holder having a base member and a plurality of spaced apart upright head members of semi- closed "C" shape adapted to receive and hold the attachment of the bottom bed clothes; the said resilient holder is positioned with its base member inserted under the corner of a water filled mattress and its plurality of head members evenly astride the adjacent sides of the same corner; the transmission of equal unidirectional hydraulic forces throughout the water filled mattress balloon its and urge and envelopment of the said resilient corner bed clothes holder and yieldably anchor the bottom bed clothes on the water filled mattress.

3 Claims, 2 Drawing Sheets

WATER BED CORNER CLOTHES HOLDER

BACKGROUND

The inventive corner bed clothes holder has at its object to overcome the problem common to water beds, namely, the inability to retain both the bottom and top bed clothes upon a water bed mattress during use.

SUMMARY

The invention serves as an all corner, flexible attachment for the bottom bed clothes, and a two corner clamping means for the foot overhang of the top bed clothes.

DETAILED DESCRIPTION

Figure 3:
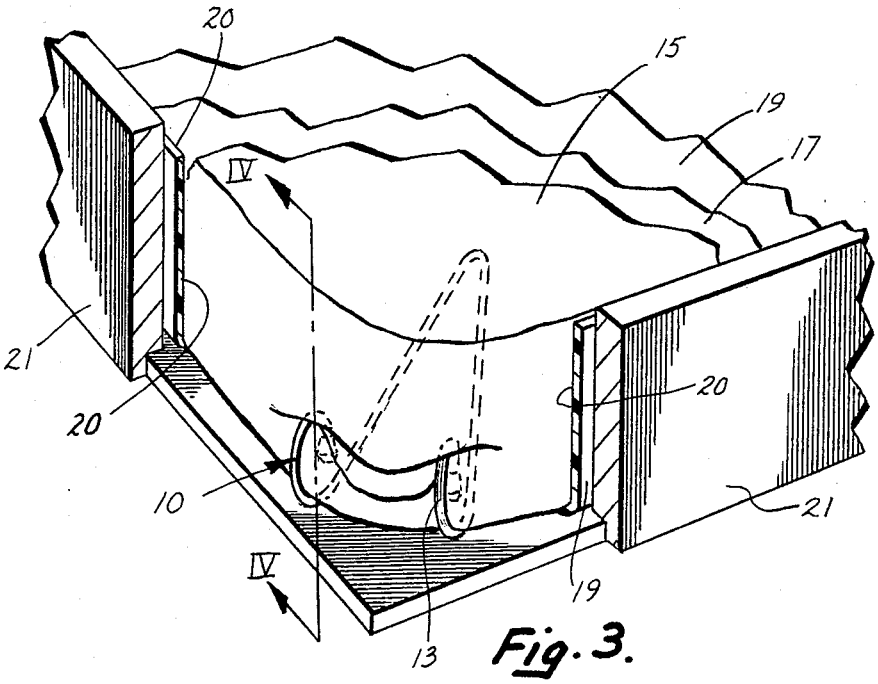
FIG. 3 is a perspective view showing the inventive device as an operative corner fixture.
Figure 1:
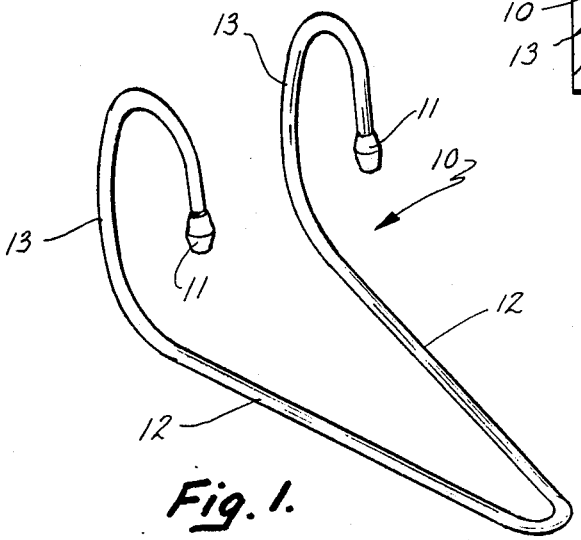
FIG. 1 is a perspective view of the preferred embodiment of the invention.

Referring to the drawings wherein like numbers designate corresponding parts throughout the several views;

The corner bed clothes holder 10, illustrated in FIG. 1 is formed from a single piece of steel rod of suitable diameter and length encased in a close fitting soft flexible plastic tube terminated at each end in a soft rubber tip 11 of an inwardly pointing cone design. The combination of rod and tubing is bent at its midpoint to form a "V" shape with rubber tipped ends 11 brought into a given proximity of each other. The two integral branches of the "V" are again bent, at a point two-thirds the overall distance from the joined ends to form a right angle between the short and long branches of the "V". The shorter branches are coiled a one-half turn inwardly toward the longer branches with the rubber tip ends 11 each a given distance from the inner surface of the respective coil stem.

The longer branches are the elongated base legs 12. The right angle bent and coiled upper shorter branches are designated coil 13. The spacing between the rubber tips 11 and the inner surface of the coil stem is designated clearance 14.

Generally, bed clothes are referred to as bottom or top. The bottom bed clothes cover the mattress whereas the top bed clothes cover the occupant. The bed sheets come in two varieties; fitted and flat. The fitted sheet usually has an elastic strip along its outer edge to permit the sheet to fit snugly around the four corners of the mattress or as in the case here, has corner pockets to contain the corners of the mattress and thereby accomplish a snug fit. The fitted sheet is used as the bottom sheet. The flat sheet is sized and shaped so as to extend over the top and sides of the mattress and is used as the top sheet.

Figure 2:
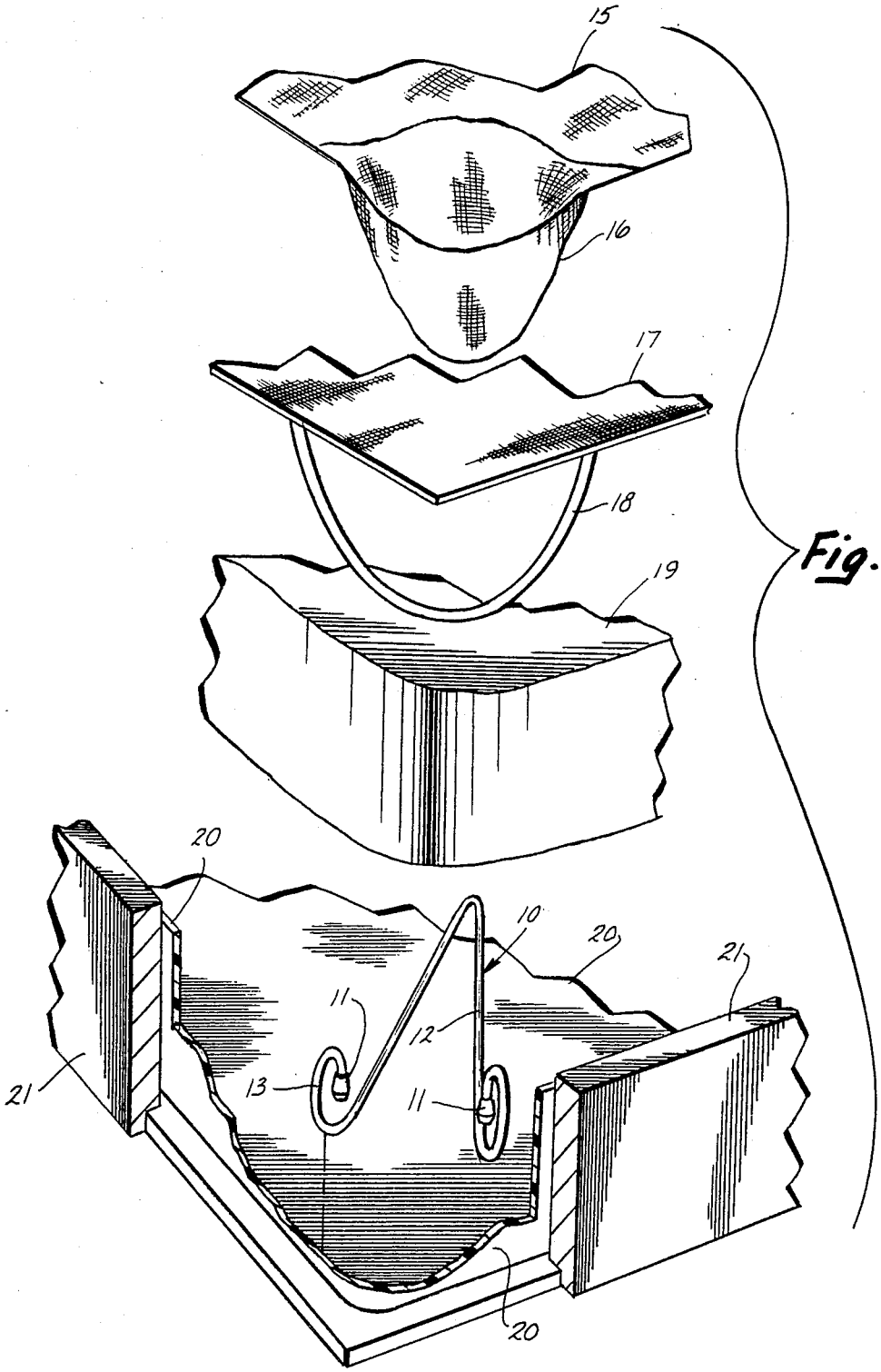
FIG. 2 is a partial view of a water bed corner showing the fitted or bottom sheet, mattress pad, water filled mattress, water tight liner and frame with the inventive corner bed clothes holder interposed between the mattress and the liner.

The uppermost article shown in FIG. 2 is the fitted or bottom sheet 15 which has an end pocket 16 (shown inverted). The next is the water bed pad 17 with its elastic retaining strap 18 intended to anchor the pad 17 about each corner of the mattress 19. Thereafter the articles are the water filled mattress 19; the water tight liner 20 and the water bed frame 21. The corner bed clothes holder 10 is shown interposed between the mattress 19 and the water tight liner 20.

FIG. 3 illustrates the holder 10 as a corner fixture with the bottom bed clothes attached. The elastic retaining strap 18 of the mattress pad 17 has been looped under the rubber tips 11 and held in space 14 by the rubber tips 11. The pocket 16 along with some adjacent corner material of the bottom sheet 15 has been rolled and tucked into clearance 14 and there held in place by the rubber tips 11. The assembly of the corner bed clothes holder 10 and the bottom bed clothes rest on the water liner 20.

Figure 4:
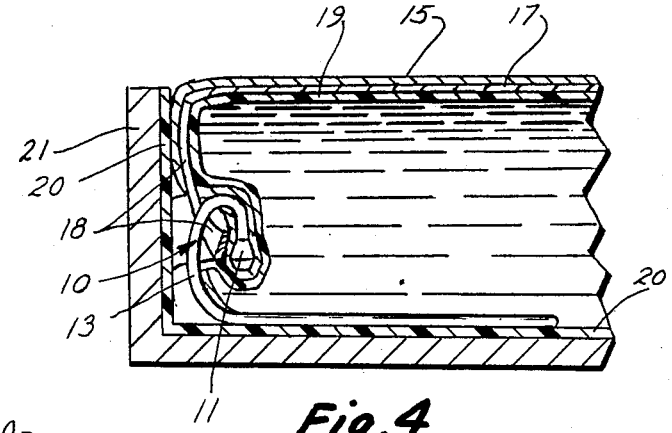
FIG. 4 is a sectional view along the lines 4—4 of FIG. 3.

The sectional view, illustrated in FIG. 4, is taken along lines 4—4 of FIG. 3. The view shows the assembly of the holder 10 and the attached bottom bed clothes a discreet distance from the corner sidewalls of frame 21. As shown in the view the coils engage the mattress at a point one half of the mattress thickness. The said attachment within the clearance 14 of coil 13 are shown held by the rubber tips 11 and surrounding side wall of the water mattress which closes the clearance 14. The corner of the water mattress 19 is soft and sponge-like as the result of the contained water. It is the flow of the water to accommodate the embedment of the holder 10 into the side wall of mattress 19 which transmits the equal unidirectional hydraulic forces throughout the mattress 19 and urges the the adjacent side wall to surround the upper portion of holder 10 with which it is in registry.

The positioning of the bed clothes holder 10 a discreet distance from the sidewall of the corner of the frame 21 is critical. The discreet distance must be maintained to prevent the coil 13 and base legs 12 by reason of inherent resilience to move the holder 10 both in a vertical as well as in a horizontal direction in following the motion of the water bed mattress 19 from rubbing against the water tight liner 20 and causing a puncture. Such an eventuality would defeat the purpose of the watertight liner 20 which in combination with the water bed frame 21 is to act as a water reservoir should the mattress 19 rupture.

In normal use, the corner bed clothes holder 10 is installed at each corner of the water bed frame 21 with the elongated base legs 12 pointing at the diagonally opposite corner and placed a discreet distance from the corner side walls of the said frame 21. This is accomplished by lifting the corner of the mattress 19 and placing the said holder 10 between the mattress 19 and watertight liner 20. Next the bottom bed clothes are attached. This is done by looping the elastic retaining strap 18 of the mattress pad 17 around the rubber tips 11 of the coil 13 and there held in the clearance 14 by the rubber tips 11. The inverted end pocket 16 along with adjacent corner material from the bottom sheet 15 is rolled and tucked into the clearance 14 and also there held by the rubber tips 11. As aforementioned, the settling of the water within the mattress 19 encloses and wedges the said bar clothes holder 10 within the folds of the mattress 19. The inherent resilience of the base legs 12 allow the legs to follow the up and down movement of the water mattress, in a similar fashion the inherent resilience of coils 13 allows the coils to follow the lateral movements of the water mattress.

The last is the placement on the water bed mattress 19 the top bed clothes consisting of a flat or top sheet, blanket, quilts, etc. Normally, these overhang the top sides and foot of the mattress 19. It is customary to tuck the bed clothes overhang at the foot of the bed between the mattress and the frame. This can also be accomplished with the water bed. The soft and spongelike corner of the water bed mattress 19 reinforced by the bed clothes holder 10 is lifted and the foot bed clothes overhang is tucked under the mattress 19. Upon release of the mattress the selected overhang is securely clamped.

By the use of this corner bed clothes holder both the top and bottom bed clothes are held in place. However, the corner bed clothes holder is also yielding and elastic to accommodate the tossing and turning of the occupant of the bed, thereby greatly reducing if not eliminating the restrictive and oppressive effect normally associated with positive and unyielding bed covers.

I claim:

1. In a waterbed including a bedframe and a water filled mattress having a plurality of soft and spongelike corners positioned within said bedframe flexible coverings with attached corner retainers upon the water filled mattress, and a corner bed clothes holder having an inherent resilience being situated at each of said plurality of corners for yieldingly anchoring by means of said attached corner retainers, the flexible coverings on said water filled mattress, each corner bed clothes holder comprising a first section consisting of a plurality of integral base legs that diverge from a common point, a second section consisting of a plurality of upright extensions each extension being integral with base leg, each of said upright extensions having a "C" shaped connector adapted to receive the said corner retainers of the said flexible coverings, the said first section of each of said corner bed clothes holders being placed diagonally under a different one of said soft and spongelike corners of the said water filled mattress a sufficient distance to embed the said "C" shaped connectors of said second section into each said corner, thereby closing off the "C" shaped connectors and securing the said corner retainers contained therein whereby the inherent resilience of the said plurality of integral base leg portions permit the said first section to follow the up and down movement of the said corners of the said water filled mattress and the inherent resilience of the said plurality of upright diverging extensions permit the said second section follow the lateral movements of the said corners of the said water filled mattress in response to the movement of the water in the said water filled mattress generated by the weight and movements of an occupant on the said water filled mattress thereby maintaining the embedded registry between the said "C" shaped connectors and the said soft and spongelike corners and yieldingly anchoring the said flexible coverings at each of said corners of the said water filled mattress.

2. A corner bed clothes holder as in claim 1 wherein the said "C" shaped connectors of the second section are positioned astride the adjacent sides of the said soft and spongelike corner of the said water filled mattress and engage the said adjacent sides at a point one-half the thickness of the said water filled mattress.

3. A resilient corner bed clothes holder for yieldingly anchoring a mattress pad and bottom sheet at the corners of a rectangular water filled mattress by means of a plurality of corner retainers attached to the mattress pad and bottom sheet, said holder comprising a plurality of resilient rod base members that diverge from a common point, each rod base member being integral with an upright resilient rod head member, the said rod base members collectively a "V" shape by bending a rod of given equal length at its midpoint, each rod head member being formed by bending a given length end portion of each rod base member into an upright position with each said end portion being formed into a "C" shape to receive and retain collectively the said corner retainers attached to the said mattress pad and the said bottom sheet, the construction and arrangement of the said resilient corner bed clothes holder being such that in use the said plurality of rod base members of each holder are inserted a sufficient distance under a different of the plurality of said corners of the said water filled mattress to embed the "C" shapes of the said rod head members into the said corners of the said water filled mattress to close shut the said "C" shapes and by reason of the inherent resilient characteristics of the said rod base members and the said rod head members the said resilient corner bed clothes holders maintain a positive embedded registry with the said corners of the said water filled mattress by following both horizontally and vertically the surging of the water within the said water filled mattress generated in response to the weight and movement of the occupant on the said water filled mattress.

* * * * *